US009422735B1

(12) United States Patent
Asplin

(10) Patent No.: US 9,422,735 B1
(45) Date of Patent: Aug. 23, 2016

(54) METHODS AND SYSTEMS OF APPLYING FORCES USING FOLDED HOSES

(71) Applicant: Charles L. Asplin, Fargo, ND (US)

(72) Inventor: Charles L. Asplin, Fargo, ND (US)

( * ) Notice: Subject to any disclaimer, the term of this patent is extended or adjusted under 35 U.S.C. 154(b) by 0 days.

(21) Appl. No.: 14/695,484

(22) Filed: Apr. 24, 2015

(51) Int. Cl.
*E04G 23/06* (2006.01)
*E02D 35/00* (2006.01)

(52) U.S. Cl.
CPC ..... *E04G 23/065* (2013.01); *E02D 35/005* (2013.01)

(58) Field of Classification Search
CPC ..... B66F 3/35; B66F 3/46; B66F 15/00; B66F 9/22
See application file for complete search history.

(56) References Cited

U.S. PATENT DOCUMENTS 4,294,141 A * 10/1981 Miller ..... B25B 11/00 254/93 HP
4,495,738 A 1/1985 Sheber
5,529,293 A * 6/1996 Haugs ..... B63B 21/20 254/93 HP
5,561,914 A 10/1996 Asplin
5,860,763 A 1/1999 Asplin
5,979,879 A 11/1999 Asplin
6,082,708 A * 7/2000 Mullican ..... B66F 3/35 254/93 HP
6,976,804 B1 12/2005 Asplin
7,226,274 B1 6/2007 Asplin
7,421,746 B1 * 9/2008 Cobi ..... E03D 11/16 254/93 HP
7,461,997 B1 12/2008 Mack, II
8,092,116 B1 * 1/2012 Asplin ..... E01C 23/10 404/78
8,186,907 B1 5/2012 Asplin
8,864,421 B2 10/2014 Asplin
2006/0117678 A1 6/2006 Neighbours
2012/0286223 A1 * 11/2012 Vigil ..... E05B 85/085 254/93 HP

FOREIGN PATENT DOCUMENTS

JP 03-047305 2/1991
JP 06-146213 5/1994
JP 2002-146717 5/2002

* cited by examiner

*Primary Examiner* — Lee D Wilson
(74) *Attorney, Agent, or Firm* — Hamre, Schumann, Mueller & Larson, P.C.

(57) ABSTRACT

An inflatable hose is folded over onto itself at least once to form inflatable hose sections. When a pressurized media is introduced into the hose, the hose sections expand in volume. The expansion in volume can be used to apply a force to a structure which can be used to, for example, move the structure in a desired direction or maintain the structure at a height or position. The force(s) can be applied to the structure in a vertical direction (for example vertically upward or vertically downward), a horizontal direction (for example to move or maintain the structure in a sideways direction) or any angle between vertical and horizontal.

12 Claims, 5 Drawing Sheets

METHODS AND SYSTEMS OF APPLYING FORCES USING FOLDED HOSES

FIELD

This disclosure relates to methods and systems of applying forces to structures. The forces can be used to lift the structures or to move the structures in any direction, or to maintain a structure at a height or position.

BACKGROUND

In some circumstances it is necessary to apply a force to a structure to move the structure in a desired direction. For example, over time structures such as roadways, driveways, houses or portions thereof, garage floors, porches, sidewalks, patios, etc., have a tendency to settle or sink and need to be raised upwardly to return the structure to its original level. In another example, it is sometimes desirable to lift a structure upwardly, even a structure that has not settled, from a first level to a second higher level. In still another example, such as in a rescue situation, it may be desirable to move a structure in a particular direction such as upward, downward, sideways, or in any other direction, such as when attempting to extricate a person.

U.S. Pat. Nos. 8,092,116 and 8,864,421 describe the use of an inflatable hose or hoses to raise structures.

SUMMARY

Methods and systems of applying forces to structures are described. The methods and systems described herein utilize an inflatable hose that is folded over onto itself at least once to form inflatable hose sections. When a pressurized media is introduced into the hose, the hose sections increase in volume. The increase in volume can be used to apply a force to a structure which can be used to, for example, move the structure in a desired direction or maintain the structure at a height or position. The force(s) can be applied to the structure in a vertical direction (for example vertically upward or vertically downward), a horizontal direction (for example to move or maintain the structure in a sideways direction) or any angle between vertical and horizontal.

The inflatable hose is folded over onto itself at least once to form first and second inflatable hose sections. In another embodiment, the inflatable hose is folded over onto itself more than once, for example twice, three times, etc., to form three or more inflatable hose sections. By folding the inflatable hose over onto itself, more force is generated when the hose sections are inflated with pressurized media compared to a single length of hose that is inflated.

In one embodiment, the hose sections are only partially inflated so that in a cross-sectional view, the hose sections are generally oval in shape which helps to ensure stability of the hose sections when the force is applied to the structure. The size and/or shape of the inflatable hose and resulting inflatable hose sections can be increased/decreased as desired depending upon the required force and the application the inflatable hose is used for.

In some embodiments, a second inflatable hose structure that is folded over onto itself can be used to apply another force to the structure. The second inflatable hose structure would be spaced from the first inflatable hose structure so that the force applied by the second inflatable hose structure is applied at a location spaced from the force applied by the first inflatable hose structure. In some embodiment, the second inflatable hose structure need not be folded over onto itself when applying the second force to the structure. For example, the second hose structure can be a hose as described in U.S. Pat. Nos. 8,092,116 and 8,864,421.

In one embodiment, a method of applying a force to a structure includes folding a first inflatable hose over on itself at least once to form at least first and second inflatable hose sections with the second inflatable hose section adjacent to the first inflatable hose section, the first and second inflatable hose sections are increasable in volume in a first direction to generate a force in the first direction. The first and second inflatable hose sections are located adjacent to the structure to be moved with the second inflatable hose section positioned between the first inflatable hose section and the structure to be moved so that when the first and second inflatable hose sections are increased in volume the force that is generated in the first direction is applied to the structure. Pressurized media is then introduced into the first inflatable hose so as to inflate the first and second inflatable hose sections to increase the volume of the first and second inflatable hose sections so that the force in the first direction is applied to the structure.

DRAWINGS

DETAILED DESCRIPTION

Figure 1:
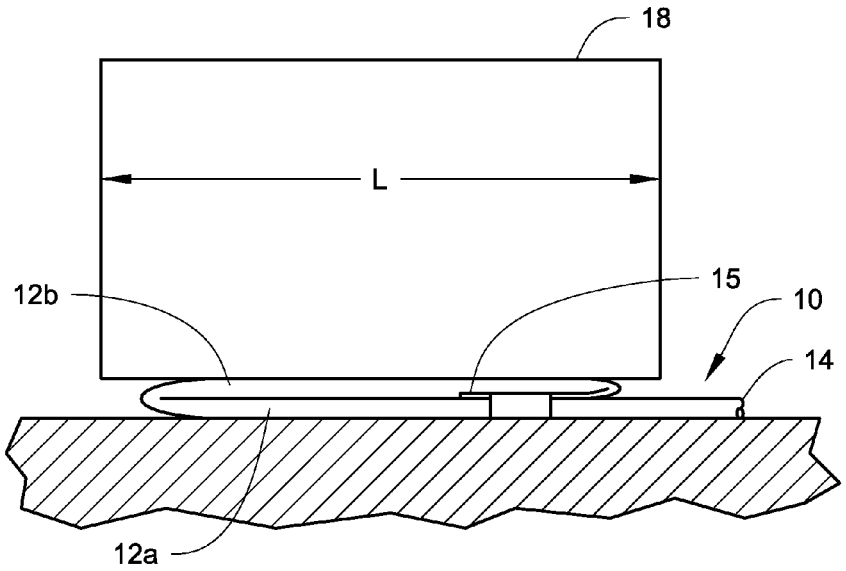
FIG. 1 is a side view of an inflatable hose described herein that is folded over onto itself and positioned underneath a structure to permit application of a vertical force to the structure.
Figure 2:
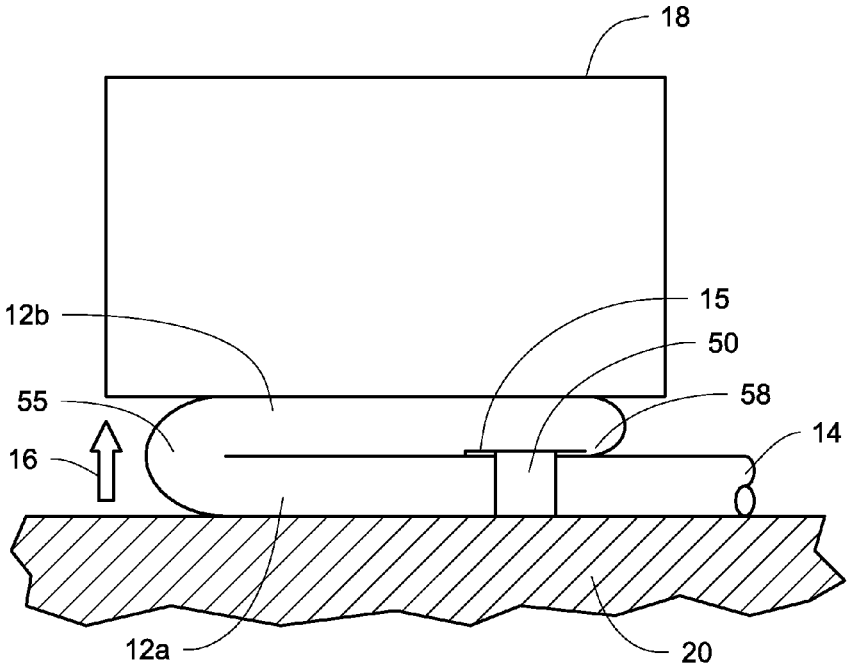
FIG. 2 is a side view similar to FIG. 1 but with the inflatable hose inflated by a pressurized media to increase the volume of the hose sections to apply the vertical force.
Figure 3:
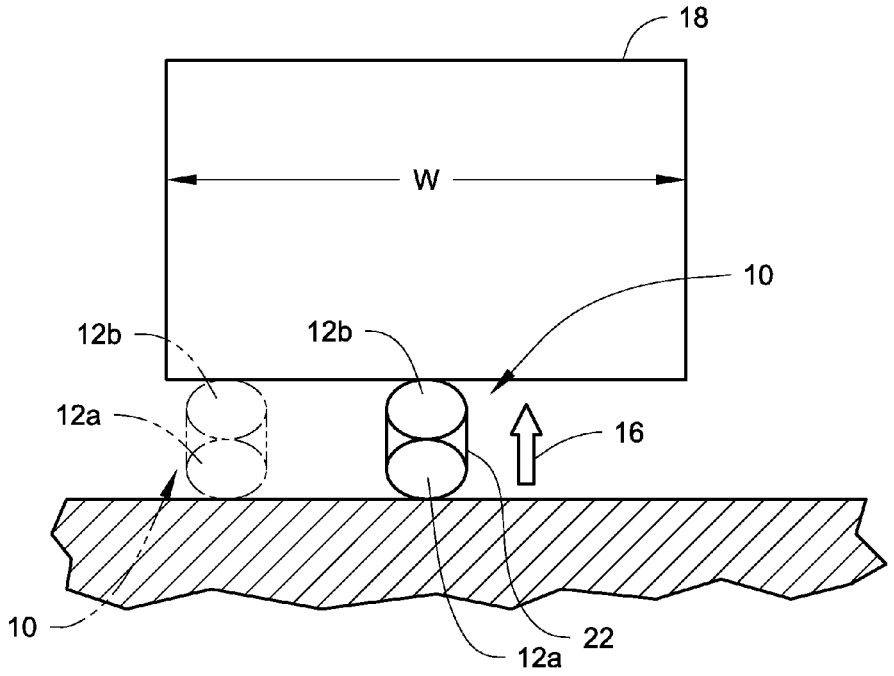
FIG. 3 is a cross-sectional end view through the hose sections of FIG. 2.

With reference to FIGS. 1-3, an inflatable hose 10 is folded over onto itself to form first and second inflatable hose sections 12*a*, 12*b*. The second inflatable hose section 12*b* is adjacent to the first inflatable hose section 12*a*, for example in direct contact with the first inflatable hose section 12*a*. In the embodiment illustrated in FIGS. 1-3, the inflatable hose section 12*b* is disposed vertically above the inflatable hose section 12*a*. The inflatable hose section 12*a* is that part of the hose 10 that is underneath the inflatable hose section 12*b* located above it. In addition, the inflatable hose sections 12*a*, 12*b* are those portions of the hose 10 that combine with one another to increase the height of the hose 10 compared to the portion of the hose 10 that is not folded over onto itself.

FIG. 1 shows the hose 10 and the inflatable hose sections 12*a*, 12*b* in a deflated or non-pressurized condition where they have minimal volume and are not applying a vertical force. A first end 14 of the hose 10 is connected to a source of pressurized media, and the second end 15 of the hose 10 is sealed in any suitable manner to prevent escape of pressurized media through the end 15. When pressurized media is introduced through the end 14 of the hose 10, the first and second inflatable hose sections 12*a*, 12*b* are increased in volume in a first direction (for example, the vertical direction in FIGS. 1-3) to generate a vertically upward force 16 in the first direction. FIGS. 2 and 3 illustrate the hose 10 and the inflatable hose sections 12*a*, 12*b* in an inflated or pressurized condition with an increased volume compared to FIG. 1.

The hose 10 is located adjacent to a structure 18 to be moved vertically upward or maintained at its vertical position. In FIGS. 1-3, the hose 10 is located underneath the structure 18 so that the vertical force 16 is applied to the structure 18 in a vertically upward direction, for example to lift the structure 18 upward. As illustrated in FIGS. 1-3, when the hose 10 is correctly positioned, the second inflatable hose section 12*b* is positioned on top of the first inflatable hose section 12*a* between the first inflatable hose section 12*a* and the structure 18. The second inflatable hose section 12*b* can be in direct contact with the structure 18, or an intervening structure such as a force spreading plate or other structure can be disposed between the second inflatable hose section 12*b* and the structure 18. The first inflatable hose section 12*a* can be located on a stabile base 20 such as the ground or a floor. FIGS. 1-3 illustrate the first inflatable hose section 12*a* directly contacting the base 20, but an intervening structure such as a force spreading plate or other structure can be disposed between the first inflatable hose section 12*a* and the base 20.

With reference to FIG. 3, in one embodiment the inflatable hose sections 12*a*, 12*b* are only partially inflated so that in a cross-sectional view, the inflatable hose sections 12*a*, 12*b* are generally oval in shape. This helps to ensure stability of the inflatable hose sections 12*a*, 12*b* when the force 16 is applied to the structure. However, the inflatable hose sections 12*a*, 12*b* can be inflatable any amount sufficient to achieve the desired goal of applying a force to the structure 18 to move the In addition, as shown in FIG. 3, one or more stabilizing bands 22 can be disposed around the inflatable hose sections 12*a*, 12*b* to help maintain the inflatable hose sections 12*a*, 12*b* vertically aligned or stacked on top of one another. The stabilizing band(s) 22 can be, for example, a rubber band(s) that expands with the inflation of the inflatable hose sections 12*a*, 12*b*.

Referring to FIG. 1, the inflatable hose sections 12*a*, 12*b* can extend any length L of the structure 18. In the embodiment illustrated in FIG. 1, the inflatable hose sections 12*a*, 12*b* extend at least 50% of the length L. Referring to FIG. 3, the inflatable hose sections 12*a*, 12*b* can be located at any position along the width W of the structure 18. In the embodiment illustrated in FIG. 3, the inflatable hose sections 12*a*, 12*b* are located approximately at the middle of the width W to apply the force 16 proximate the center of the structure 18.

FIG. 3 also illustrates an alternative location of the inflatable hose sections 12*a*, 12*b* in dashed lines, where the inflatable hose sections 12*a*, 12*b* are positioned off center toward one side of the structure 18. Alternatively, the inflatable hose sections 12*a*, 12*b* illustrated in dashed lines in FIG. 3 indicate that a second inflatable hose 10, similar or identical in construction to the first inflatable hose 10, can be used to apply a second force to the structure 18. The second inflatable hose 10 is spaced from the first inflatable hose 10 so that the force 16 applied by the second inflatable hose 10 is applied at a location spaced from the force 16 applied by the first inflatable hose 10, but with the two forces 16 combining to lift the structure 18 or maintain the structure 18 at its current height.

Figure 4:
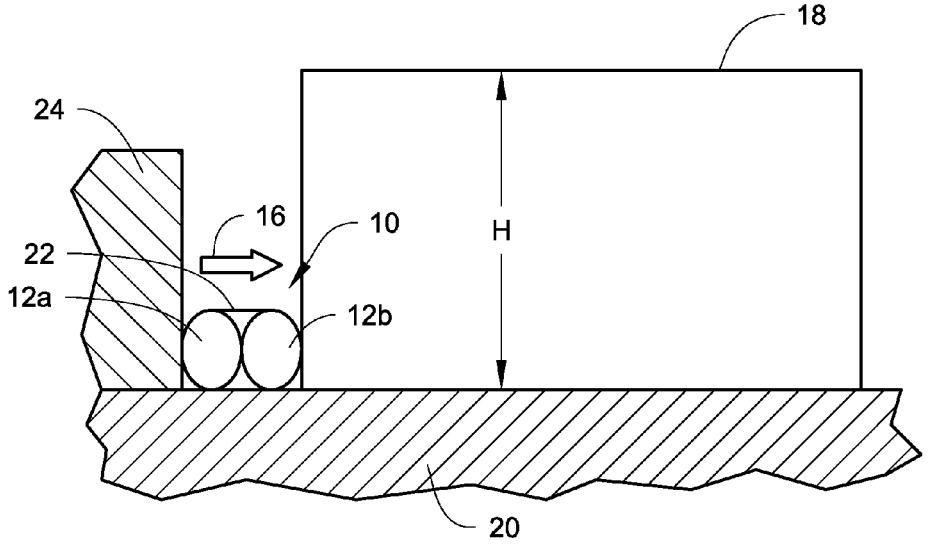
FIG. 4 is an end view of an inflatable hose described herein that is folded over onto itself and positioned to the side of a structure to apply a horizontal force to the structure.

FIG. 4 illustrates the inflatable hose 10 positioned to the side of the structure 18 to apply the force 16 in a horizontal direction to the structure 18. In this embodiment, the inflatable hose 10 can be positioned on the base 20 between a side of the structure 18 and a second stabile base 24. When pressurized media is introduced into the inflatable hose 10, the inflatable hose sections 12*a*, 12*b* expand in volume to create the horizontal force 16 on the structure 18 to move the structure 18 sideways or to maintain the horizontal position of the structure 18 spaced from the stabile base 24. The inflatable hose 10 can be positioned at any location along the vertical height H of the structure 18 so that the force 16 is applied at any location along the height H. Optionally, one or more of the stabilizing bands 22 can be used to help maintain the relative positions of the inflatable hose sections 12*a*, 12*b*. In addition, more than one of the inflatable hoses 10 can be positioned to apply multiple forces 16 to the structure 18. Further, the embodiments of FIGS. 1-3 and FIG. 4 can be combined, so that one or more of the inflatable hoses 10 can apply one or more forces 16 vertically while one or more of the inflatable hoses can apply one or more forces 16 horizontally.

Figure 5:
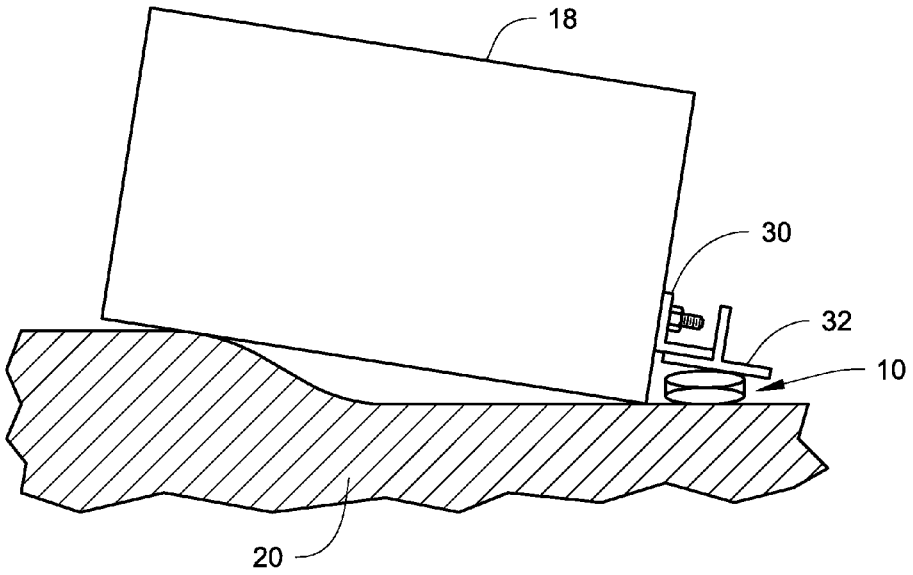
FIG. 5 illustrates an inflatable hose described herein that is folded over onto itself and positioned to apply a force to a lifting bracket that is fixed to the structure.
Figure 6:
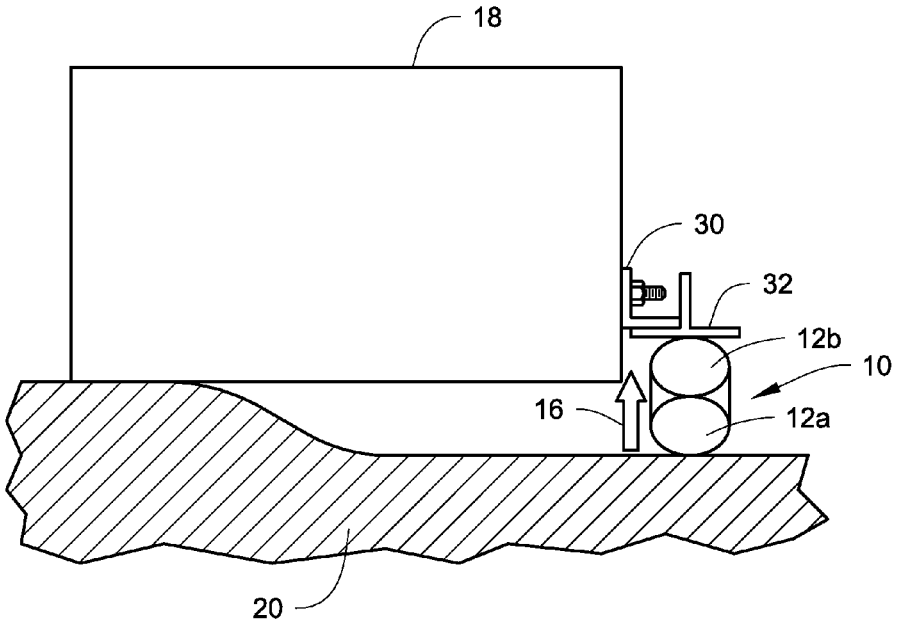
FIG. 6 is a view similar to FIG. 5 but with the inflatable hose inflated by a pressurized media to increase the volume of the hose sections.

FIGS. 5 and 6 illustrate an embodiment where one or more of the inflatable hoses 10 indirectly apply forces to the structure 18. In this embodiment, one or more angle brackets 30 are fixed to the side of the structure 18, and one or more lift brackets 32 are engaged between the angle bracket(s) 30 and the inflatable hose(s) 10. FIG. 5 shows the inflatable hose(s) 10 positioned underneath the lift bracket(s) 32 in its deflated or non-pressurized condition. As shown in FIG. 6, upon introduction of pressurized media into the inflatable hose, the inflatable hose sections 12*a*, 12*b* expand in volume, creating the upward force 16 on the lift bracket 32 which is transferred to the angle bracket 30 and to the structure 18. The end of the structure 18 is then lifted upward as shown in FIG. 6 from its original position shown in FIG. 5. Further information on the use of angle and lift brackets to aid in lifting a structure is described in U.S. Pat. No. 8,864,421 the entire contents of which are incorporated herein by reference. Optionally, fill material can be introduced underneath the structure 18 once it is raised to fill the now empty space shown in FIG. 6.

Figure 7:
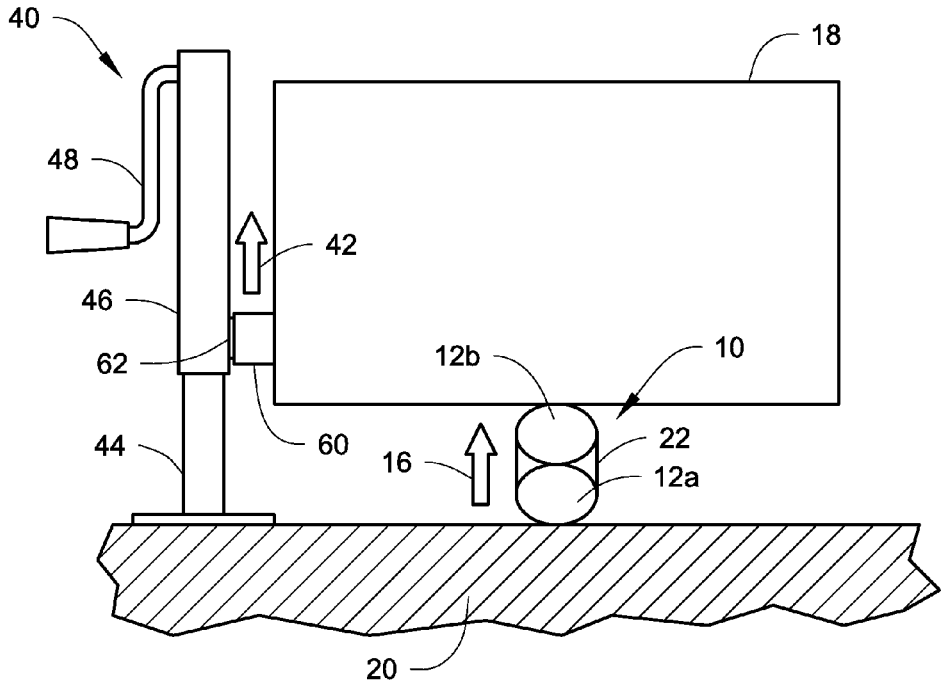
FIG. 7 is a view similar to FIG. 3 but also showing a crank jack that applies a vertical force to the structure to supplement the force of the inflatable hose.

In some embodiments, the force(s) applied by the one or more inflatable hose(s) 10 can be supplemented by other mechanical lifting mechanisms. For example, FIG. 7 is a view similar to FIG. 3 showing the inflatable hose sections 12*a*, 12*b* expanded with pressurized media so they are applying the upward force 16 on the structure 18. In addition, the upward force 16 applied by the inflatable hose sections 12*a*, 12*b* is supplemented by one or more crank jacks 40 that apply a vertical force 42 to the structure 18 to supplement the force 16 of the inflatable hose sections 12*a*, 12*b*.

The construction and operation of the crank jack 40 is well known in the art. Each crank jack 40 includes a base 44 that rests on the stabile base 20. The base 44 is telescoped within a movable sleeve 46 that moves up and down on the base 44. A rotatable crank handle 48 is connected to a mechanism within the crank jack 40 such that rotation of the crank handle 48 in one direction causes the sleeve 46 to be moved upwardly on the base 44, while rotation of the crank handle 48 in the opposite direction causes the sleeve 46 to slide down on the base 44.

The crank jack(s) 40 can be coupled to the structure 18 in any suitable manner such that upward movement of the sleeve 46 applies an upward force to the structure 18. For example, in one embodiment illustrated in FIG. 7, a bracket 60 can be fixed to the side of the structure 18 and a structure 62 on the sleeve 46 of the crank jack 40 engages with the bracket 60 to apply the upward force from the crank jack 40 to the structure 18.

The use of one or more supplemental lifting mechanisms such as the crank jack(s) 40 can aid in the inflatable hose in lifting the structure 18. Alternatively, the supplemental lifting mechanisms such as the crank jack(s) 40 can act as a fail-safe measure to hold the structure 18 up if pressure escapes from the inflatable hose 10 and the inflatable hose 10 deflates.

FIGS. 8-12 illustrate one example of a sequence of operations of folding the inflatable hose 10 over onto itself to form the inflatable hose sections 12*a*, 12*b* and sealing the second end 15 of the hose. Other sequences are possible.

Figure 8:
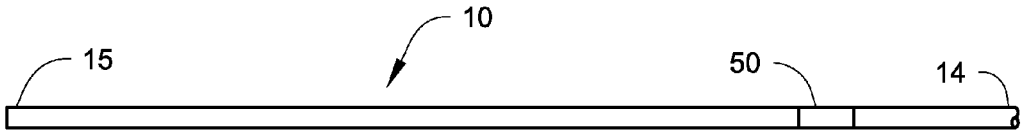
FIGS. 8-12 illustrate various steps involved in folding the inflatable hose over onto itself to create first and second hose sections.

FIG. 8 illustrates the inflatable hose 10 in an initial unfolded condition. The first end 14 can be connected to a source of pressurized media at this stage, or the connection of the first end 14 to the source of pressurized media can occur later. In addition, in this embodiment, the second end 15 of the hose 10 can be initially open or unsealed so that if pressurized media were to be introduced into the inflatable hose, the pressurized media would escape out the end 15. A sealing band 50 is shown disposed around the inflatable hose 10. The sealing band 50 is used to help seal the second end 15 of the inflatable hose 10 as discussed further below.

Figure 9:
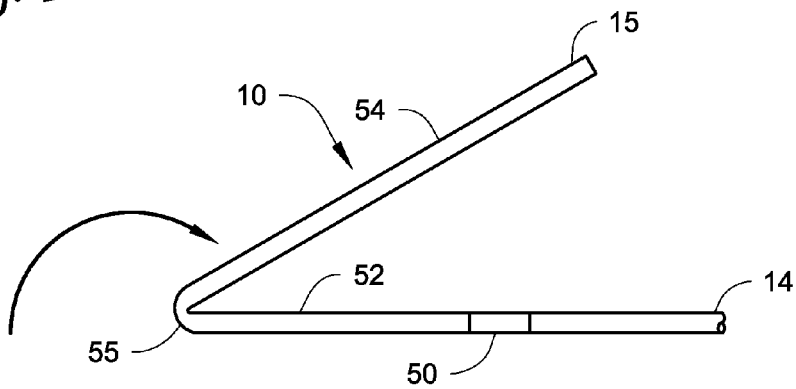

FIG. 9 illustrates the inflatable hose 10 being folded over onto itself in a clockwise direction (i.e. in the direction of the arrow) into a lower part 52 and an upper part 54 separated by a bend 55. The hose 10 should be folded such that the second end 15 significantly overlaps the sealing band 50.

Figure 10:
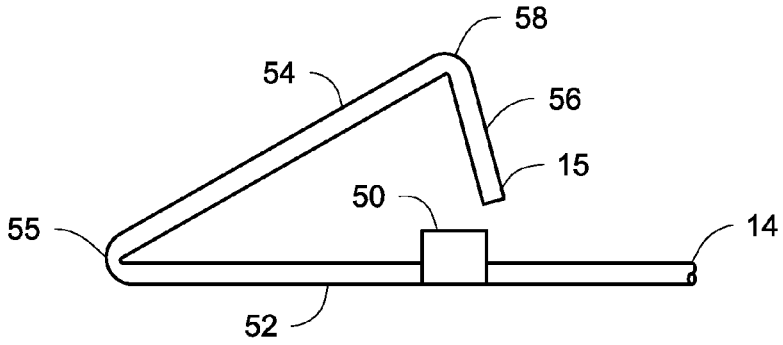
Figure 11:
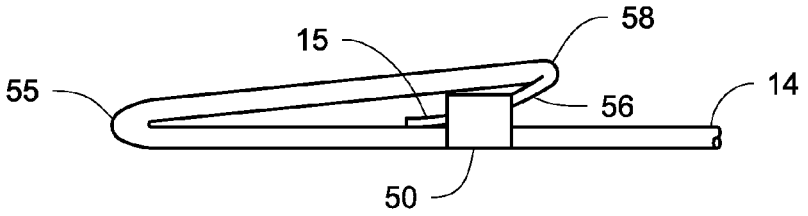

FIG. 10 illustrates that a portion 56 of the upper part 54 containing the second end 15 is then folded downward toward the lower part 52 at a bend 58. The portion 56 including the second end 15 is then directed in a reverse direction back through the sealing band 50 such that the portion 56 is disposed between the sealing band 50 and the lower part 52 of the inflatable hose 10 as shown in FIG. 11. The sealing band 50 is a sleeve that is disposed around the lower part 52 that permits the second end 15 to be passed through the sealing band 50 in the reverse direction between the sealing band 50 and the lower part 52 as depicted in FIGS. 10 and 11. In the illustrated embodiment, the second end 15 completely extends through the sealing band 50. In one embodiment, the sealing band 50 can be made of the same material as the hose 10. For example, approximately a six inch length of hose can be cut from the hose 10 to form the sealing band 50, and then slid over the lower part 52. The second end 15 can then be reversed and passed through the sealing band 50 as seen in FIGS. 10 and 11. However, other forms and lengths of sealing bands 50 can be used.

Figure 12:
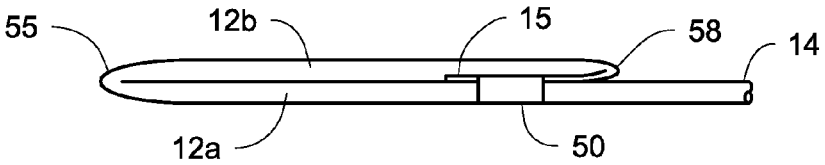

Once the portion 56 and the second end 15 are sufficiently reversed back through the sealing band 50, the portion 56 is disposed between the sealing band 50 and the lower part 52 of the inflatable hose 10 as shown in FIG. 12. In addition, the portion 56, including the second end 15, is disposed between the inflatable hose section 12*b* and the inflatable hose section 12*a*.

The sealing band 50 seals the second end 15 of the inflatable hose 10 by pinching the portion 56 between the sealing band 50 and the lower part 52 of the inflatable hose 10. Upon the introduction of pressurized media through the first end 14, the pressurized media expands the inflatable hose section 12*a*, and flows through the bend 55 and expands the inflatable hose section 12*b*. The portion 56 and the second end 15 are disposed between the expanded hose sections 12*a*, 12*b* which also helps to seal the second end 15 and prevent escape of the pressurized media through the second end 15. As shown in FIG. 2, the inflatable hose sections 12*a*, 12*b* expand in volume. However, due to the sealing band 50 which seals the second end 15, the pressurized media does not flow past the sealing band 50.

In embodiments where the inflatable hose 10 is folded over onto itself more than once, the sequence and construction shown in FIGS. 8-12 can vary slightly. For example, in the case of the inflatable hose 10 being folded over onto itself twice, a portion of the upper part 54 shown in FIG. 9 can be folded upwardly and then reversed in direction over the remainder of the upper part 54 so that three inflatable hose sections are formed. The sealing band 50 can be located on the middle hose section so that a portion of the uppermost hose section can be reversed back through the sealing band in a similar manner to the portion 56. In such a construction, the reversed portion of the uppermost hose section would be pinched between the sealing band and the middle hose section to seal the open end of the inflatable hose.

The inflatable hose 10 can be made from any suitable material such as rubber, canvas, nylon or the like, as long as the inflatable hose 10 can maintain pressurized media therein when inflated, the inflatable hose 10 can withstand the forces of the pressurized media and engagement with the structure 18 and the base 20, and the inflatable hose 10 is inflatable to increase the volume of the inflatable hose sections 12*a*, 12*b* from the collapsed or non-pressurized condition.

The inflatable hose 10 is described above as being partially inflated so that the inflatable hose sections 12*a*, 12*b* assume an oval shape. However, the inflatable hose 10 itself can be shaped such that when fully inflated the inflatable hose sections 12*a*, 12*b* have an oval cross-sectional shape. Alternatively, the inflatable hose sections 12*a*, 12*b* can have a circular cross-sectional shape, a rectangular cross-sectional shape, a polygonal cross-sectional shape, or an irregular shape when partially or fully inflated.

The pressurized media used to inflate the inflatable hose can be any pressurized media such as pressurized gases such as air and pressurized liquids such as water. The pressurized media can be injected from a suitable pressurized media source (not shown) and is injected through the end 14 which can be provided with a suitable fitting (not shown) to connect to the pressurized media source. In another embodiment, the second end 15 need not be closed, but can instead be connected back to the pressurized media source to form a closed looped circulation system. The pressure of the pressurized media can be constant, or the pressure of the pressurized media may vary.

When the inflatable hose 10 is intended to lift a structure, the increase in size of the inflatable hose sections resulting from inflation creates an upward lifting force on the structure that is sufficient to lift the structure. The size of the hose that is used can be sufficient such that when folded over onto itself to form the inflatable hose sections, the structure is lifted upward a sufficient distance to raise the structure to a desired level. Further, the inflatable hose sections need not be fully inflated. The inflatable hose sections only need be inflated enough to raise the structure to the desired level. In addition, the size of the hose and pressure of the pressurized media should be sufficient to create enough upward lifting force to lift the weight of the structure. When it is desired to implement the method while the structure remains in use, the upward force should be sufficient to support both the structure and any objects on the top surface of the structure. In such an embodiment, the pressure of the pressurized media introduced into the inflatable hose sections may vary during use. In this manner, the structure can be raised while the structure remains in use.

When the inflatable hose 10 is intended to maintain a structure at a desired height, the upward lifting force on the structure that is generated should be sufficient to keep the structure raised at its current height. The size of the hose that is used can be sufficient such that when folded over onto itself to form the inflatable hose sections, and the inflatable hose sections are expanded, the expanded hose sections engage the structure and can accept the weight of the structure without collapsing. The inflatable hose sections need not be fully inflated. The inflatable hose sections only need be inflated enough to engage the structure and maintain the structure at the desired level when the weight of the structure is applied to the hose sections. In addition, the size of the hose and pressure of the pressurized media should be sufficient to support the weight of the structure. When it is desired to implement the method while the structure remains in use, the upward force of the hose sections should be sufficient to support both the structure and any objects on structure during use. In such an embodiment, the pressure of the pressurized media introduced into the inflatable hose sections may vary during use. In this manner, the structure can be maintained at a raised position while the structure remains in use.

When the force of the inflatable hose sections 12*a*, 12*b* is no longer required, the hose sections 12*a*, 12*b* can be deflated by allowing the pressurized media to escape from the hose sections 12*a*, 12*b*, for example through the first end 14 or through one or more suitable valves (not shown) provided in the hose sections 12*a*, 12*b*.

The examples disclosed in this application are to be considered in all respects as illustrative and not limitative. The scope of the invention is indicated by the appended claims rather than by the foregoing description; and all changes which come within the meaning and range of equivalency of the claims are intended to be embraced therein.

The invention claimed is:

1. A method of applying a force to a structure, comprising:

folding a first inflatable hose over on itself at least once to form at least first and second inflatable hose sections with the second inflatable hose section adjacent to the first inflatable hose section, the first and second inflatable hose sections are increasable in volume in a first direction to generate a force in the first direction;

locating the first and second inflatable hose sections adjacent to the structure with the second inflatable hose section positioned between the first inflatable hose section and the structure so that when the first and second inflatable hose sections are increased in volume the force that is generated in the first direction is applied to the structure; and introducing pressurized media into the first inflatable hose so as to inflate the first and second inflatable hose sections to increase the volume of the first and second inflatable hose sections so that the force in the first direction is applied to the structure.

2. The method of claim 1, wherein the pressurized media comprises air or a liquid.

3. The method of claim 1, wherein the force is a substantially vertical force, and the first and second inflatable hose sections are located adjacent to the structure to apply the substantially vertical force to the structure.

4. The method of claim 3, wherein the substantially vertical force is applied to the structure adjacent to a center of the structure.

5. The method of claim 3, wherein the substantially vertical force is applied to the structure offset from a center of the structure.

6. The method of claim 1, wherein the force is a substantially horizontal force, and the first and second inflatable hose sections are located adjacent to the structure to apply the substantially horizontal force to the structure.

7. The method of claim 1, further comprising:

folding a second inflatable hose over on itself at least once to form at least third and fourth inflatable hose sections with the fourth inflatable hose section adjacent to the third inflatable hose section, the third and fourth inflatable hose sections are increasable in volume in the first direction to generate a second force in the first direction;

locating the third and fourth inflatable hose sections adjacent to the structure with the fourth inflatable hose section positioned between the third inflatable hose section and the structure so that when the third and fourth inflatable hose sections are increased in volume the second force that is generated in the first direction is applied to the structure;

introducing pressurized media into the second inflatable hose so as to inflate the third and fourth inflatable hose sections to increase the volume of the third and fourth inflatable hose sections so that the second force in the first direction is applied to the structure.

8. The method of claim 1, further comprising locating at least one crank jack adjacent to the structure, and applying a force in the first direction from the at least one crank jack to the structure to supplement the force of the first and second inflatable hose sections.

9. The method of claim 1, wherein the first inflatable hose includes an open end that is not sealed; and wherein folding the first inflatable hose over on itself at least once to form the first and second inflatable hose sections comprises locating the open end of the first inflatable hose between the first inflatable hose section and the second inflatable hose section.

10. The method of claim 9, comprising locating a sealing band around the first inflatable hose section, and placing the open end of the first inflatable hose through the sealing band when the first inflatable hose is folded over on itself to form the first and second inflatable hose sections and the open end of the first inflatable hose is located between the first inflatable hose section and the second inflatable hose section.

11. The method of claim 1, further comprising locating an alignment band around the first and second inflatable hose sections to maintain alignment between the first and second inflatable hose sections.

12. The method of claim 1, further comprising folding the first inflatable hose over on itself at least twice to form at least the first inflatable hose section, the second inflatable hose section, and a third inflatable hose section, with the second inflatable hose section adjacent to and between the first and third inflatable hose sections.

* * * * *